United States Patent [19]

Faust

[11] 4,311,891

[45] Jan. 19, 1982

[54] VEHICLE ALARM SHAKER DEVICE WITH SPRING DAMPER

[75] Inventor: James H. Faust, Maricopa, Ariz.

[73] Assignee: ABC Auto Alarms, Inc., Elk Grove Village, Ill.

[21] Appl. No.: 141,114

[22] Filed: Apr. 17, 1980

[51] Int. Cl.[3] ..... H01H 35/02

[52] U.S. Cl. ..... 200/61.45 R; 200/61.48; 200/61.49; 200/288; 340/65

[58] Field of Search ..... 200/61.45 R, 61.45 M, 200/288, 61.49, 61.51, 61.52, 61.48; 340/669, 65; 307/10 AT

[56] References Cited

U.S. PATENT DOCUMENTS 3,165,608 1/1965 Wallace ..... 335/193 X 3,188,407 6/1965 Avgerinos ..... 200/288

FOREIGN PATENT DOCUMENTS 611556 3/1935 Fed. Rep. of Germany ..... 174/42

791820 12/1935 France ..... 174/42

1399971 4/1965 France ..... 200/61.49

*Primary Examiner*—J. V. Truhe

*Assistant Examiner*—Morris Ginsburg

*Attorney, Agent, or Firm*—Silverman, Cass & Singer, Ltd.

[57] ABSTRACT

A shaker device for automobile alarm systems in which there is a vibratory member for making contact when the vehicle is disturbed and in which the vibratory member is damped by means of a relatively stiff cantilever supported member made out of spring wire.

6 Claims, 4 Drawing Figures

FIG. 1
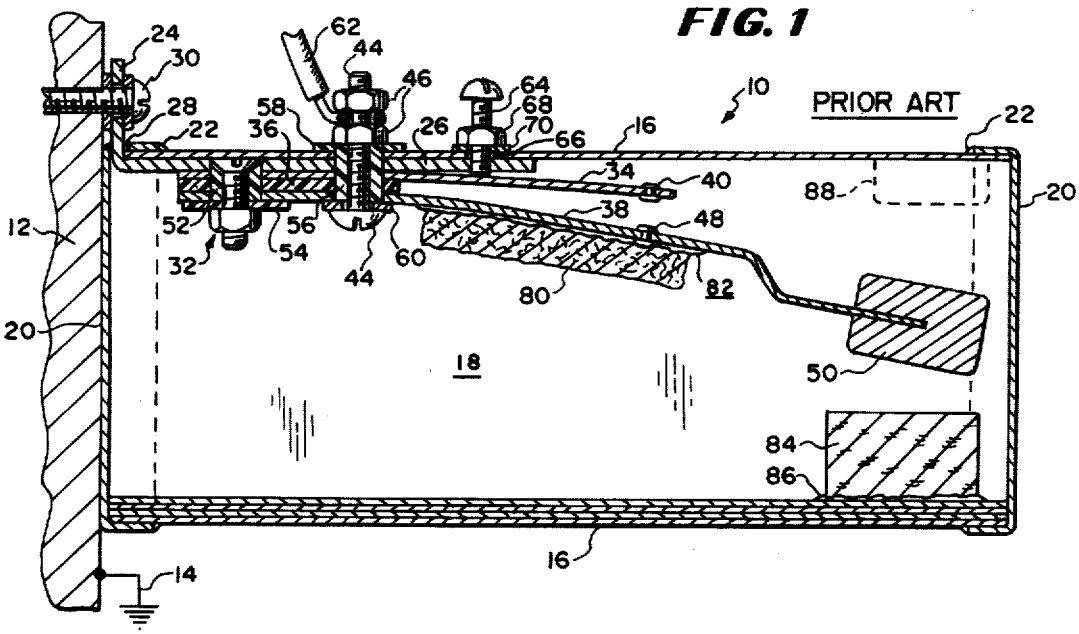
FIG. 3
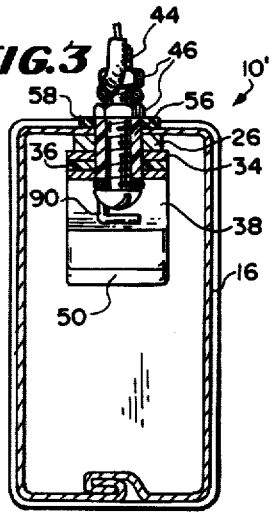
FIG. 2
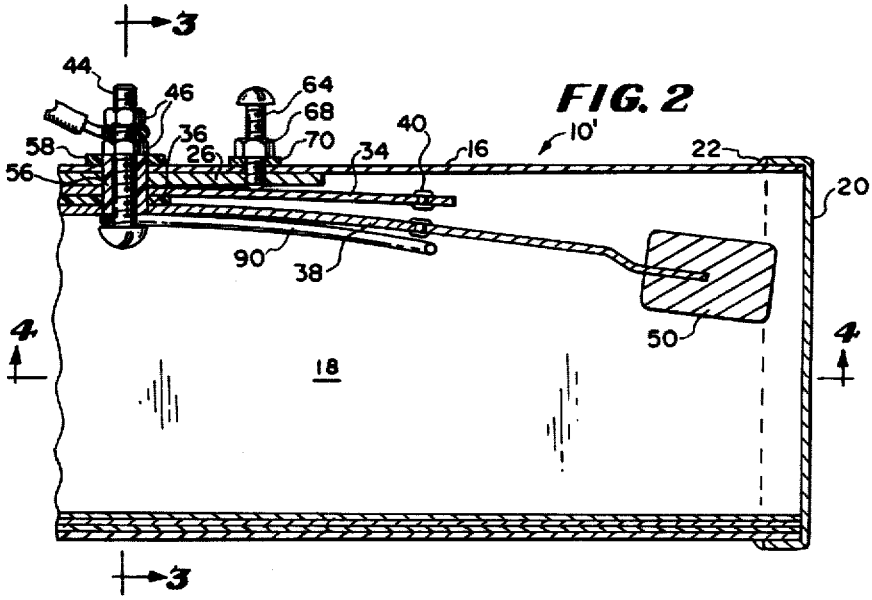
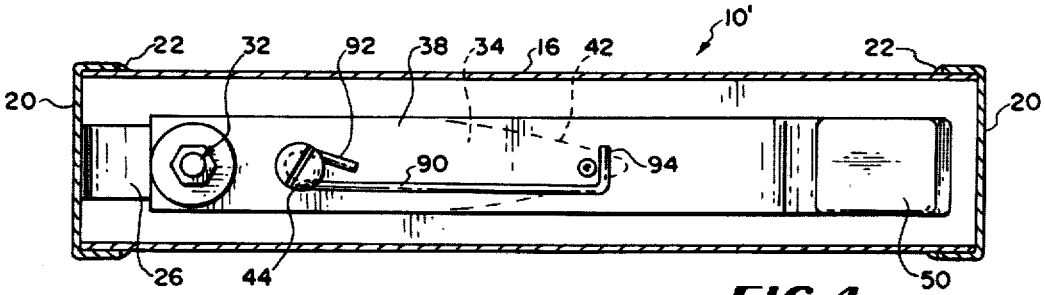
FIG. 4

VEHICLE ALARM SHAKER DEVICE WITH SPRING DAMPER

BACKGROUND OF THE INVENTION

The invention is concerned with a so-called shaker device for use in automobile and the like alarm systems.

The shaker of an automobile alarm system is a device which has a vibratory member that is supported for free movement at one end thereof, the freely moving end being provided with an electrical contact. There is another member having a cooperating contact disposed in a position to be engaged by the moving contact when the amplitude of the vibratory member is great enough.

The vibratory member is usually a substantially flat steel spring supported at one end and having a heavy weight at the other end to decrease the period of vibration and to provide a relatively greater amplitude of vibration than such a spring without a weight. If contact is made an alarm is energized. If the vehicle is standing a sharp blow or movement of the vehicle will set the vibratory member moving and sound the alarm.

The known construction of shaker has several disadvantages. One is that the normal movement of the automobile or other vehicle produces a continuous vibration even when the alarm system is turned off and this in turn knocks repeatedly on the housing of the shaker. This is annoying to the occupants of the vehicle. A second disadvantage is that the movement of the car occupant getting out of the vehicle sets the vibratory member of the known construction vibrating for a relatively long time requiring the occupant to wait until the amplitude has decreased to an extent that the vibratory member does not make electrical contact with the fixed contact so that the alarm can be armed without being immediately sounded.

In order to decrease the time of vibration and dampen the movement of the vibratory member it has been known to secure a damping member on the vibratory member and bumpers on the interior of the shaker housing to deaden the sound of the weight striking the housing. The cost of the damping member and the bumpers and the labor in installing the same increase the cost of the shaker device while not contributing functionally to the operation of the device in the alarm system.

The invention eliminates the bumpers and provides a novel damping device which decreases the amplitude and period of vibration of the vibratory member.

SUMMARY OF THE INVENTION

A vehicle alarm system shaker device which comprises a vibratory member anchored at one end within a housing and having a weight at its free end with an electrical contact mounted on the vibratory member spaced from its anchored end. The vibratory member has an electrical connection to the exterior of the housing so as to enable its being connected to an alarm system. A fixed contact is arranged to be engaged by the moving contact to close the alarm circuit.

A relatively stiff spring wire member is mounted to the anchoring means for the vibratory member and arranged so that the swinging movement of the vibratory member in a direction away from the fixed contact, that is downward, will be opposed by the wire member. The greater the amplitude, the greater the resistance of the wire member. As a result the vibration is decreased in amplitude and damped, rapidly cutting down on its period.

BRIEF DESCRIPTION OF THE DRAWING

FIG. 1 is a median sectional view through a shaker device of the prior art here shown mounted to a vehicle structural member;

FIG. 2 is a fragmentary view similar to that of FIG. 1 but showing the construction of a shaker device according to the invention;

FIG. 3 is a sectional view taken through FIG. 2 along the plane 3—3 and in the indicated direction; and FIG. 4 is a sectional view through the shaker device of the invention taken generally along a plane 4—4 indicated in FIG. 2 and looking upward, the view including the portion of the shaker device which is cut away in FIG. 2.

DESCRIPTION OF THE PREFERRED EMBODIMENT

The invention herein is a shaker device which differs from the prior art in only one respect but the said difference is important because it improves the function and operation of the shaker device and renders the shaker device easier and more economical to make.

As previously mentioned a shaker device is an article mounted in a vehicle intended to close an electrical circuit when the vehicle is disturbed physically. Such disturbance could be caused by someone breaking into the vehicle, striking it or attempting to move it. The electrical circuit which is closed comprises a detector or transducer which responds to the closing of the circuit and operates an alarm.

In FIG. 1 there is illustrated a prior art shaker device 10 which is here shown mounted to a metal structural member 12 of a vehicle whose frame is grounded as at 14. The shaker device 10 comprises a canister or housing 16 of aluminum or other metal having an interior chamber 18 closed off at its ends by the caps 20. The caps 20 are normally sealed in place by some adhesive 22 or can be soldered or crimped in place. An ear 24 of metal that is an extension of the interior support strap 26 protrudes from the left hand cap 20 which may have a slot 28 for this purpose. The ear 24 is pierced to enable a screw of the like fastener 30 to mount the shaker device 10. The arrangement obviously grounds the shaker housing 16 through metal to metal contact and by virtue of an adjusting screw also which will be described.

A stack of three flat elongate members is clamped within the chamber 18 to the interior support strap 26 by means of the screw and nut 32. These three members are an upper resilient contact-carrying member 34, a central short strip of sheet insulating material 36 and a bottom metal vibratory member 38.

The contact-carrying member 34 is made of resilient metal such as spring steel or phosphor bronze and is held flat against the interior support strap 26 by the screw and nut 32. It carries an electrical contact button 40 at its right hand end which may be tapered as indicated at 42 in FIG. 4. Because of its engagement with the interior support strap 26, the contact button 40 is grounded to the vehicle structural member 12.

There is a terminal screw 44 which also passes through the stack of flat elongate members 34, 36 and 38 and as well through the interior support strap 26 and the upper wall of the housing 16 for a purpose to be described. This screw 44 and its nuts 46 also clamp the stack of members in place so that they are also anchored at the location of the screw 44. The connection of the stack of members at two locations prevents their being twisted out of disposition parallel with the long dimension of the housing 16.

The short strip 36 separates and insulates the contact carrying member and the vibratory member 38.

The vibratory member 38 is an elongate strip of resilient material such as flat spring steel which has a second contact button 48 mounted at a location spaced from the screw 44 juxtaposed relative to the button 40 so that if the vibratory member 38 swings upward as viewed in FIG. 1 by a sufficient amplitude the buttons will come into engagement. The vibratory member 38 has a relatively heavy weight 50 secured to its free end to increase the amplitude of swinging and to decrease the period of vibration.

The screw 32 is surrounded by a sleeve 52 of insulating material and each of the flat members 34, 36 and 38 has a perforation which is large enough to accommodate the sleeve 52. At its bottom end the screw and nut fastener 32 is provided with an insulating washer 54. The purpose for this arrangement is to insulate the fixed end of the vibratory member 38 from ground. The terminal screw 44 makes contact with the vibratory member 38 only and is insulated from ground. There is an opening in each of the members 26, 34, 36 and the upper wall of the housing 16 aligned with one another and of a diameter sufficient to accommodate an insulating sleeve 56. There is an insulating washer 58 overlying the upper wall of the housing 16 and the lower of the two nuts 46 clamps everything tightly so that the screw 44 is in effect the last anchoring support for the members 34 and 38. A lock washer 60 ensures contact between the vibratory member 38 and the terminal screw 44. An electrical lead 62 which extends to the alarm system of the vehicle is in contacting engagement with the screw 44 and clamped in position by the upper of the nuts 46.

There is an adjusting screw 64 which passes through an opening 66 in the housing 16, is threaded through a threaded passageway in the support strap 26 and has its bottom end engaged against the top of the contact carrying member 34. Turning the screw from the exterior of the device 10 will adjust the position of the button 40 since the right hand end of the member 34 is otherwise free. This is the fixed contact. The adjusted position can be locked in place by the nut 68 and washer 70.

The device 10 must be mounted so that its disposition is vertical with the weight 50 holding the vibratory member 38 downward and away from the fixed contact 40. When motion is applied to the vehicle, the vibratory member 38 being resilient commences to swing vertically and the electrical contact between the lead 62 and ground 14 is effected through engagement of the contact buttons 40 and 48.

In order to dampen the vibrations of the member 38 it is presently known to cement a large strip of felt or other similar material to the vibratory member 38 in the center thereof. Such a felt block or strip is shown at 80 held in place by cement 82. To prevent the repeated knocking of metal on metal during vibration of the member 38, it is usual to cement a cork block 84 to the bottom of the housing 16 by means of the cement 86. A similar member 88 may be cemented to the inside of the housing 16 on the bottom of the top wall at the point where a large upward swing of the member 38 would carry the lead weight 50 into engagement with the housing wall.

The invention 10' is illustrated in FIGS. 2, 3 and 4. All of the equivalent components of the shaker device 10 are identified in the shaker device 10' by the same reference numerals. The damping member 80 and the bumpers 84 and 88 are not shown since these are eliminated. The expense thereof and the labor for installing the same are thus obviated.

In place of these members there is a relatively stiff wire member 90 that has one end 92 wrapped around the screw 44 in the form of a loop and held firmly by the screw head. The other end 94 has a right angle bend and extends transversely of the vibratory member 38 beneath the same. As seen in FIG. 2, the wire member 90 is cantilever mounted and a portion of its body lies against the bottom of the vibratory member 38 and diverges slightly therefrom while the vibratory member is quiescent. This supports the vibratory member 38 somewhat. If the vibratory member 38 tends to move downwardly, it is resisted by the wire member 90 in a damping action. Small excursions are resisted less than larger excursions so that the damping member 90 acts to prevent large amplitude excursions and at the same time dampens the vibration, decreasing its period.

Because the excursions have less amplitude there is no need for bumpers like 84 and 88 so that the expense thereof is eliminated.

Good results are achieved when the length of the vibratory member 38 that is free, is about twice the length of the wire member 90. In a practical device, the member 38 was about 4¾" from the screw 44 to the end of weight 50. The wire 90 was about 2⅜" long.

The wire damping member 90 may take different forms but basically consists of a member anchored by the screw 44 and lying partially against the vibratory member 38 but diverging therefrom. It can be formed out of the material which is popularly known as piano wire, being quite resilient and having good recovery characteristics. A practical embodiment used tempered stainless steel spring wire of 0.047" gauge.

The vertical height of the housing 16 is shown in the drawing to be the same in both the prior art device of FIG. 1 and the novel structure of the invention, but this is only to illustrate that the movement can be achieved with the very minimum of expense. Because the excursions or amplitudes of vibration of the vibratory member 38 are decreased the housing can be made smaller.

The benefits of the invention include the absence of annoying knocking and the decrease of the time within which the alarm can be armed. Other benefits will be apparent to those skilled in this art and such persons will also appreciate that variations can be made in the details of the invention without departing from the spirit or scope thereof as defined in the appended claims.

What it is desired to secure by Letters Patent of the United States is:

1. In a shaker device for a vehicle equipped with an alarm system in which there is a housing adapted to be mounted to a grounded structural member of the vehicle, the housing has an elongate, substantially flat vibratory member anchored at one end thereof within the housing and having a weight at its free end whereby movement of the vehicle will cause the free end to vibrate in a vertical plane, there is a fixed contact carrying member within the housing having a first electrical contact facing the vibratory member, the vibratory member carrying a second electrical contact juxtaposed relative to the first electrical contact, the contacts adapted to come into engagement when the vibratory member makes a sufficient upward excursion, the two contacts being insulated from one another when not engaged and the shaker device having means for extending electrical connections from the contacts to an alarm circuit so that engagement of the contacts will close the circuit at least momentarily, the shaker device having means for damping and limiting the excursions of the vibratory member, the invention being an improvement upon said damping and limiting means and comprising:

a cantilever supported member of resilient material connected to the vibratory member at the end where same is anchored and disposed on the bottom thereof being partially in engagement with the bottom of the said vibratory member and diverging therefrom, the supported member being substantially shorter than the vibratory member and adapted to be progressively engaged along its length with the vibratory member in direct relation to the amount of excursion of the vibratory member downward so that the resistance of the supported member to such excursion increases with an increase in excursion of the vibratory member.

2. The invention as claimed in claim 1 in which the damping and limiting means comprise a length of spring wire.

3. The invention as claimed in claim 1 in which the damping and limiting means comprise a length of spring wire having a loop at its anchored end and means engaging said loop and also anchoring said vibratory member.

4. The invention as claimed in claim 3 in which there is a bend at the free end of the length of wire extending transverse of the length of said vibratory member.

5. The invention as claimed in claim 2 in which the length of spring wire is approximately half the length of the vibratory member.

6. The invention as claimed in claim 1 in which there are common means anchoring the fixed contact carrying member, the vibratory member and the damping and limiting means at the same location.

* * * * *